US005720147A

United States Patent [19]

Wenrick et al.

[11] Patent Number: 5,720,147

[45] Date of Patent: Feb. 24, 1998

[54] METHOD OF INSULATING METAL DECK ROOF STRUCTURES

[75] Inventors: Dennis K. Wenrick, Oviedo, Fla.; Don A. Neifer, Granville, Ohio; Richard T. Janicki, Oaklawn, Ill.

[73] Assignee: Owens-Corning Fiberglass Technology, Inc., Summit, Ill.

[21] Appl. No.: 716,592

[22] Filed: Sep. 18, 1996

Related U.S. Application Data

[63] Continuation-in-part of Ser. No. 645,993, May 14, 1996.

[51] Int. Cl.[6] ..... E04B 7/00

[52] U.S. Cl. ..... 52/745.06; 52/741.4; 52/746.11; 52/748.11

[58] Field of Search ..... 52/741.4, 745.06, 52/746.11, 748.11, 404.3, 406.1, 406.3, 408

[56] References Cited

U.S. PATENT DOCUMENTS

| | | |
|---|---|---|
| 3,559,914 | 2/1971 | Alderman . |
| 3,969,863 | 7/1976 | Alderman . |
| 4,047,345 | 9/1977 | Alderman . |
| 4,047,346 | 9/1977 | Alderman . |
| 4,068,446 | 1/1978 | Brueske . |
| 4,075,807 | 2/1978 | Alderman . |
| 4,147,003 | 4/1979 | Alderman . |
| 4,222,212 | 9/1980 | Alderman . |
| 4,263,763 | 4/1981 | Bouwens . |
| 4,434,601 | 3/1984 | Zellmer . |
| 4,446,664 | 5/1984 | Harkins . |
| 4,736,552 | 4/1988 | Ward et al. . |
| 4,967,535 | 11/1990 | Alderman . |
| 4,996,803 | 3/1991 | Karrfalt et al. . |
| 5,165,210 | 11/1992 | Partyka et al. . |
| 5,495,698 | 3/1996 | Alderman et al. . |

*Primary Examiner*—Christopher Kent

*Attorney, Agent, or Firm*—C. Michael Gegenheimer; Curtis B. Brueske

[57] ABSTRACT

A method for providing a roof structure having a plurality of trusses spaced apart from one another in a parallel arrangement is disclosed. The trusses each have a top portion. A support sheet is payed out so that the support sheet depends from the top portions of adjacent trusses. Flexible insulation material is applied above the support sheet so that the flexible insulation material is supported by the support sheet. Metal deck sheets are fastened to the top portion of the trusses, thereby forming a metal deck. A temporary waterproofing sealant is applied to the metal deck to protect the flexible insulation material, thereby creating a partially completed roof structure. Rigid insulation board and a waterproofing membrane are subsequently applied onto the metal deck, thereby forming a completed permanently sealed roof structure.

23 Claims, 3 Drawing Sheets

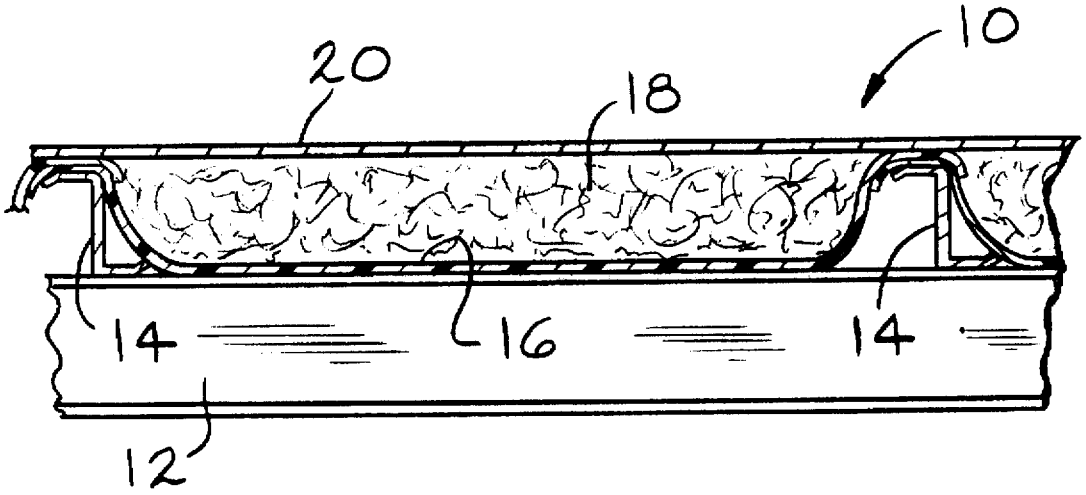
FIG. 1
PRIOR ART
FIG. 2
PRIOR ART
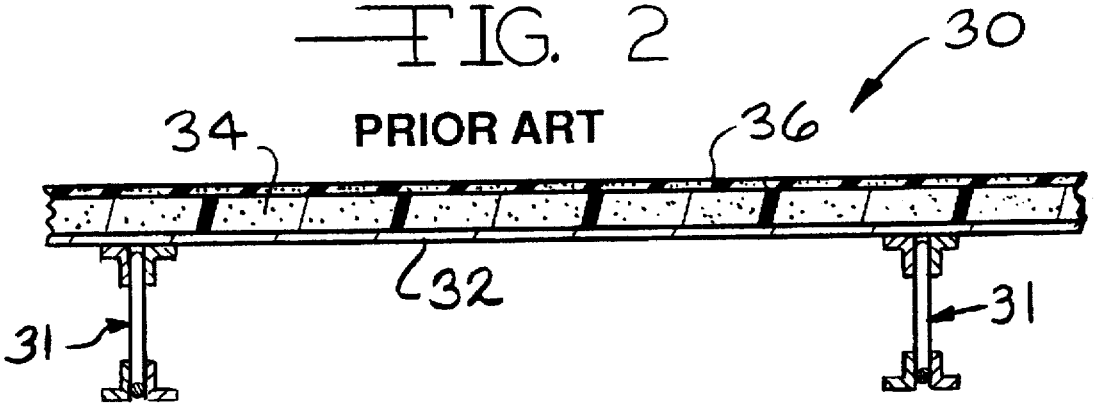

FIG. 4
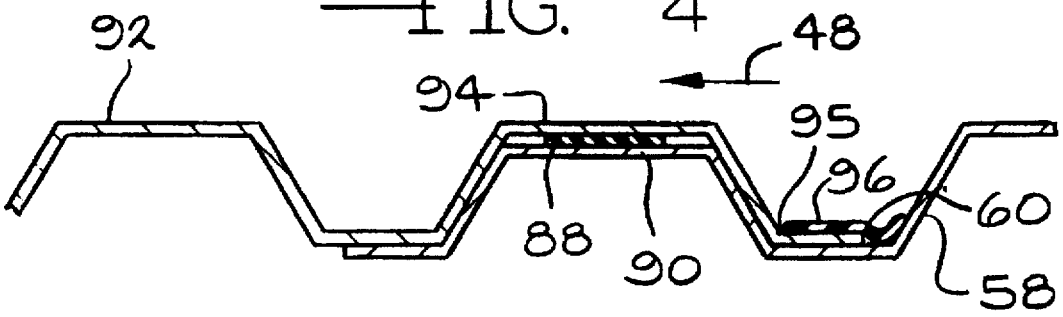
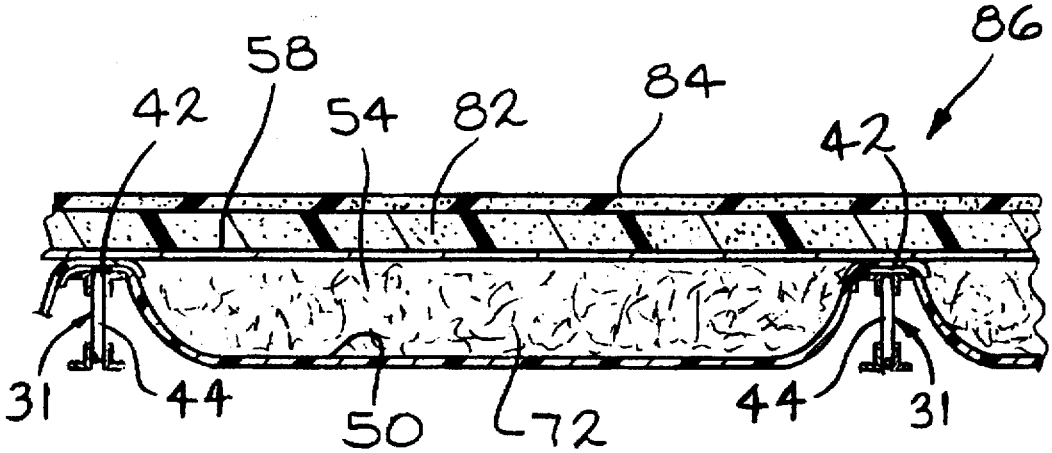
FIG. 5

METHOD OF INSULATING METAL DECK ROOF STRUCTURES

This application is a continuation-in-part of related application 08/645,993 filed May 14, 1996.

TECHNICAL FIELD

This invention relates to the construe/ion of an insulated metal roof structure for use in commercial and industrial buildings.

BACKGROUND ART

Metal roof structures typically comprise a framework of a plurality of structural beams, such as trusses, bar joists, and purlins. The roofs are commonly insulated. Various methods of providing an insulated roof structure have been used.

A first prior art roof structure comprises a plurality of rafter beams extending across the building in one direction and a plurality of purlins parallel to each other mounted on top of the rafters extending in a direction normal to the rafters. The roof structure utilizes long sheets of flexible insulation material which are positioned in the area between purlins. Because the flexible insulation can be placed in the area between purlins, a relatively thick layer of insulation can be used in this type of insulated roof structure, providing a roof structure with relatively good insulation properties, or R-values. The insulation material can be laid along the length of the purlins or across the purlins in a direction normal to the purlins. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet.

Some systems dispense with the lattice and use the sheet itself to support the insulation material. The support sheet is draped from the adjacent purlins and the insulation material is placed on top of the support sheet. A carriage has been used to aid in the dispensing of the support sheet. The carriage is positioned on top of the purlins and travels the length of the purlins during the roof construction. A roll of the support sheet material is mounted on the carriage and the support sheet is payed out from the roll and placed on top of the purlins. As the carriage travels the length of the purlins, the support sheet is draped across the purlins. The use of the carriage generally greatly speeds installation time, and generally greatly decreases the installed cost of the insulation material.

Metal panels are then fastened to the purlins over the insulation material. Because the metal panels come in long sheets and the roofs often have two sloped sections, it is customary to construct the roof along the length of the structure from one end to the other. The workers stand on the previously laid section of roof to construct the next section. Since the metal panels are exposed to the outdoor weather environment, the metal panels are fastened together such that a waterproof seal exists, thus providing for a waterproof roof structure. The metal panels are made from relatively expensive materials, such as galvanized steel, galvanized aluminum, or copper. The metal panels commonly have interlocking structures and pre-applied sealant. These waterproof sealing methods are relatively expensive due to the cost of the panels and the labor associated with assembling them.

A second prior art roof structure comprises a plurality of parallel trusses or bar joists which are mounted on a supporting girder. The roof structure includes relatively inexpensive metal deck sheets which are fastened to the trusses. Generally, the metal deck sheets are not fastened together such that they provide for a waterproof seal, and they are made from relatively inexpensive metals. Rigid insulation board, such as styrene foam or high density glass wool, is then applied on top of the metal deck sheets. Under certain conditions, such as in colder climates, the use of additional layers of rigid insulation board in this insulated roof structure has a decreasing cost effectiveness as the thickness of the rigid insulation board increases. It is therefore difficult many times to cost-effectively achieve relatively high insulating properties with this type of insulated roof structure. A waterproof membrane, such as a flexible rubber membrane, or a built up roofing system (BUR) is applied over the rigid insulation board. If a leak is developed in the membrane, the rigid insulation board saturates with water and the insulating qualities of the roof structure are decreased.

Although the above mentioned roof structures are adequate, it often is desirable to have a relatively low cost roof structure having relatively high insulating properties, i.e., a higher R-value. In addition, it would be desirable to have a method of building a roof structure which is cost effective and efficient to build, which provides for a roof structure having relatively high insulating characteristics, and which provides protection from water damage for the insulating material within the roof structure.

DISCLOSURE OF THE INVENTION

There has now been invented an improved method of building a roof structure which is cost effective and efficient to build, and allows for relatively high insulation values. The roof is constructed by installing flexible insulation material between trusses, applying metal deck panels to the trusses, and applying a temporary waterproofing sealant to the metal deck. Subsequently, a permanent waterproofing membrane is applied on top of the metal deck. This method allows the flexible insulation material to be protected from water damage during the construction of the roof structure prior to the application of a permanent waterproofing membrane. The permanently waterproofed roof structure has relatively high insulating characteristics.

The present invention comprises a method for providing a roof structure having a plurality of trusses spaced apart from one another in a parallel arrangement. A support sheet is payed out so that the support sheet depends from the top portions of adjacent trusses. The support sheet is preferably payed out from a carriage which moves along the length of the trusses as the roof structure is being built. Flexible insulation material is applied above the support sheet so that the flexible insulation material is supported by the support sheet. Metal deck sheets are fastened to the top portion of the trusses in an overlapping manner, thereby forming a metal deck having seams. A temporary waterproofing sealant is applied to the metal deck to protect the flexible insulation material from water damage prior to the application of a permanent waterproof membrane being applied, thereby creating a partially completed roof structure. The temporary waterproofing sealant can be applied between the metal deck sheets at the regions where they overlap, or can be applied over the seams of the metal deck. Rigid insulation board and a waterproofing membrane are subsequently applied onto the metal deck, thereby forming a completed permanently sealed roof structure.

BRIEF DESCRIPTION OF THE DRAWINGS

FIG. 1 is a schematic sectional view of a prior art roof structure in which flexible insulation is installed between purlins.

FIG. 2 is a schematic sectional view of another prior art roof structure in which rigid insulation is installed above trusses.

FIG. 4 is an enlarged schematic sectional view illustrating the temporary sealing of two adjacent metal deck sheets.

FIG. 5 is a schematic sectional view of a completed roof structure installed according to the present invention.

DETAILED DESCRIPTION

Figure 3:
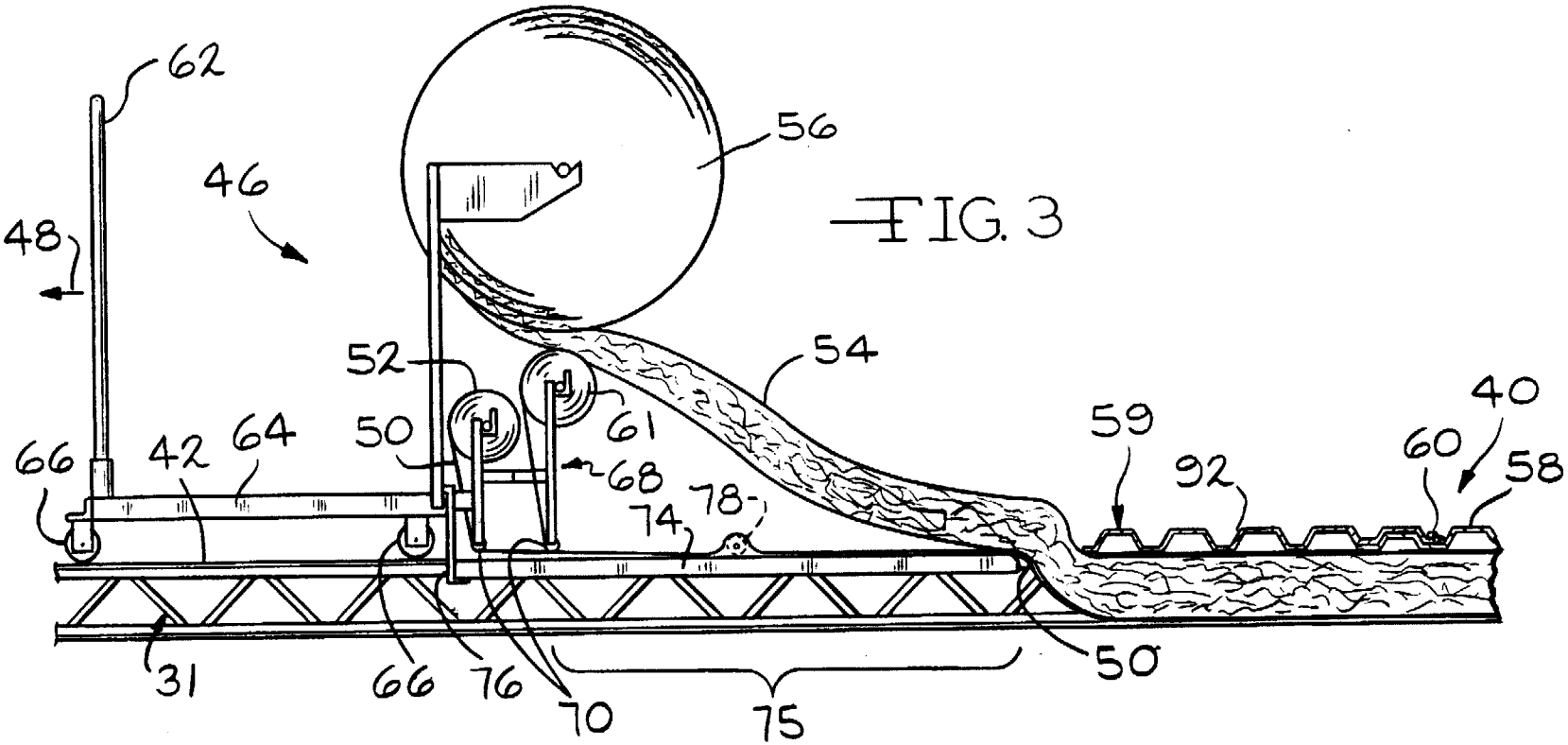
FIG. 3 is a schematic side elevational view of a carriage for paying out insulation and a support sheet according to the present invention.

There is illustrated in FIG. 1 a prior art roof structure, generally indicated at 10. The roof structure includes a plurality of parallel rafters 12 extending across the building in one direction and a plurality of purlins 14 which are parallel to each other mounted on top of the rafters extending in a direction normal to the rafters. A support sheet 16 is draped across adjacent purlins and flexible insulation material 18 is laid on top of the support sheet. Metal panels 20 are then fastened to the purlins 14 above the flexible insulation material so that the edges of the support sheet are sandwiched between the metal panels and the purlin, thereby supporting the support sheet and the flexible insulation material. Since the metal panels are exposed to the outdoor weather environment, the metal panels are fastened together such that a waterproof seal exists, thus providing for a waterproof roof structure. For example, the metal panels commonly have interlocking structures having pre-applied sealant in the interlocking areas. The metal panels are made from relatively expensive materials, such as galvanized steel, galvanized aluminum, or copper.

FIG. 2 illustrates a different prior art roof structure, indicated generally at 30. The roof structure includes a plurality of parallel bar joists or trusses 31 which are mounted on supporting girders (not shown). A metal deck sheet 32 is fastened to the trusses. Rigid insulation board 34 is placed on top of the metal deck sheets. A waterproof membrane 36 is then applied on top of the rigid insulation board, thereby forming a waterproof roof structure.

There is illustrated in FIG. 3 a partially completed roof structure, indicated generally at 40, being installed in accordance with the present invention. The roof structure is supported by girders (not shown). The trusses 31 are spaced apart and arranged parallel to each other. The spacing of the trusses is typically 4 feet (1.46 m) on centers. As shown in FIG. 5, the trusses include a top portion 42 and a vertical portion 44. Roof structures may also be constructed using bar joists or other similar structures. The use of the term "trusses" in this specification and claims includes not only traditional trusses, but also bar joists and other similar structural members.

Broadly stated, the partially completed roof structure 40 is constructed by use of a carriage 46 which rides on the top portion of the trusses and travels along the length of the trusses in a downstream direction, represented by an arrow 48. As the carriage is moved, a support sheet 50 is payed out from a roll 52. The support sheet is draped on top of adjacent trusses so that the support sheet depends from the top portion of the trusses. The support sheet supports a layer of flexible insulation material 54 which is placed on top of the support sheet between the adjacent trusses. The flexible insulation material is payed out from a roll 56.

The carriage 46 can be any length up to the width of the roof itself. Preferably, the carriage is comprised of a plurality of carriage sections which can be joined together so that they span the entire width of the sloped section of the roof. The carriage is then propelled across the trusses by pulling means, such as a winch (not shown), in the downstream direction 48 so that all the carriage sections move in unison.

Since the support sheet is draped across the top portion of adjacent trusses, the total width of the support sheet is wider than the distance between the trusses. Therefore, adjacent support sheet rolls are not co-linear and must be slightly staggered. Typically, a carriage section covers two truss spans, i.e., about 10 feet (3.7 m) in length. Preferably, each carriage section has both a leading roll 52 and a trailing roll 61 of insulation support sheet, one roll for each of two adjacent truss spans. The edge of the support sheet from the trailing roll 61 will be draped on top of the edge of the support sheet from the leading roll 52 as the carriage moves in the downstream direction. Multiple identical carriage sections, each having a leading and trailing roll, can therefore be joined together, with every roll being staggered from an adjacent roll.

The carriage can be any suitable apparatus that moves along the top of the trusses and dispenses the support sheet. As seen from FIG. 3, the carriage 46 includes safety handrails 62 and a walking deck 64 for the worker to stand on while operating or moving the carriage. Preferably, the carriage has hourglass-shaped rollers 66 riding on the top portion 42 of the trusses 31 for ease of movement and to maintain the carriage in alignment with the trusses. The carriage also includes a framework 68 for mounting the rolls 52 and 61. Although two support sheet rolls are shown in FIG. 3, one is the leading roll 52 shown in the background, and the other is the trailing roll 61 shown in the foreground. Mounted on the framework are turning bars 70 which extend laterally across the support sheet and are positioned slightly above the top portions 42 of the trusses 31 so as to direct the support sheet to a generally horizontal position.

The space between the vertical portions 44 of adjacent trusses 31 defines an insulation cavity 72, as seen from FIG. 5. The insulation cavity has a generally rectangular cross-sectional shape. It is advantageous to fill out the insulation cavity uniformly with the flexible insulation material without leaving relatively large gaps, thereby maximizing the insulating qualities of the roof structure. The purpose of the support sheet 50 is to support the flexible insulation material in the insulation cavity, but the support sheet can also be used as a vapor barrier and for aesthetic purposes. A pleated support sheet which reduces the width of the rolls 52 and 61 can be used. The pleated support sheet unfolds as it is payed out in the insulation cavity. The support sheet can also be perforated so as allow any water inside the insulation cavity to escape, thus helping to prevent a loss in the insulating quality of the flexible insulation material. The support sheet can be of any suitable material for the stated purposes, such as vinyl or foil faced paper.

Attached to the carriage is a plate 74 which extends from the carriage 46 in an upstream direction opposite the downstream direction 48. Instead of being mounted on the carriage, the roll 56 of flexible insulation material 54 can be rested on the plate. The plate supports the payed out support sheet so that the support sheet does not drape downwardly, thereby pulling the longitudinal edges of the support sheet off of the top portion 42 of the trusses. Generally, the plate is located in a gap 75 which exists between the partially completed roof structure 40 and the carriage 46. The plate hinders wind from blowing vertically through the gap 75 which could disturb the flexible insulation material 54 and the support sheet 50. If built with sufficient strength, the plate can be used for fall protection for the workers to prevent them from falling off the leading edge of the previously completed section of roof. As used in this specification and claims, the term "fall protection" means that the plate will withstand a live load of 25 lbs/ft$^2$ (1200N/m$^2$). This should be adequate to support a worker inadvertently stepping on the plate. The plate, however, can be constructed in any suitable manner. The plate can be attached to the carriage by any suitable means, such as by a plurality of hooks 76 which extend vertically from the plate. The hooks are simply hung on the carriage thereby supporting one end of the plate. The other end of the plate is supported by rollers 78 which ride along the top portion of the trusses.

After the flexible insulation material has been placed on the support sheet, long sheets of hard roofing material, such as metal deck sheets 58, are then attached to the top portion of the trusses over the support sheet and insulation. The plurality of metal deck sheets form a metal deck 59. The attachment of the metal deck sheets presses down on the edges of the support sheet which are sandwiched between the top portions 42 of the trusses and the metal deck sheets, so that the support sheet supports the insulation between the trusses.

The metal deck sheets 58 typically have longitudinally extending corrugations to provide for structural strength. Preferably, the metal deck sheets are made of a relatively inexpensive material not having weather treatment applied to the surface areas. The metal deck sheets 58 of the present invention are fastened to the top portion of the trusses 31 in an overlapping manner thereby creating a seam 60, as shown more clearly in the enlarged view of FIG. 4. The metal deck sheets can be fastened to the trusses in any suitable manner, such as by threaded fasteners. The metal deck sheets come in long sheets, typically 30 to 35 feet (10.9 to 12.8 m), and the roof would generally have a single sloped section. A section of the roof structure is constructed first along the width of the sloped section, and then the roof is constructed down the length of the structure from one end to the other. The workers stand on the previously attached first section of the roof structure to assemble the next section of roof. The carriage travels along the length of the trusses and is moved by the workers as each new section of roof is assembled.

As stated before, FIG. 3 illustrates a partially completed roof structure 40. Typically, the invention is carried out by having a team of deck insulation installers, using the carriage system as described above, construct the partially completed roof structure 40. Afterwards, a team of roofers will apply rigid insulation board 82 and a waterproof membrane 84 over the roof structure 40 to form a complete permanent waterproof roof structure, indicated generally at 86 in FIG. 5. Since the lapse of time between the construction of the partially completed roof structure 40 and the completed roof structure 86 can be as long as several weeks, the partially completed roof structure 40 should be protected from moderate weather conditions, such as rain, snow, wind, and direct sunlight. Particularly, of greatest concern is protecting the flexible insulation material from moisture. Since the partially completed roof structure 40 will eventually be covered from the weather elements by a permanent waterproofing system, the cost of the temporary protection should be held to a minimum, and be yet able to withstand the harmful outdoor environment. The method of the present invention solves this problem by applying a temporary waterproofing sealant to the relatively inexpensive metal deck 59 subsequent to the construction of the partially completed roof structure 40.

During construction of the partially completed roof structure 40, a first metal deck sheet 58 is positioned over the payed out flexible insulation material 54 and the support sheet 50, and is fastened to the top portion 42 of the trusses 31. As shown in FIG. 4, a first layer of temporary waterproofing sealant 88 is applied along a longitudinal edge portion 90 of the first metal deck sheet 58. The sealant can be any suitable sealant which provides for a temporary sealing, such as a bead of asphalt-based sealant applied by a caulking apparatus, or an adhesive strip of mastic. It is desirable that the sealant remain relatively viscous when exposed to the elevated temperatures that can be experienced on a metal deck roof on a sunny summer day, so that the sealant will not flow out of sealing contact under such conditions. Preferably, therefore, the sealant has a melting point above about 165° F. More preferably, the sealant is an asphalt that has been oxidized to have a melting point between about 165° F. and about 200° F., and, most preferably, between about 165° F. and about 185° F. Such an asphalt would preferably have an ASTM D5 penetration at 77° F. ranging between about 15 dmm and about 60 dmm, and, more preferably, between about 18 dmm and about 30 dmm.

The edge portion 90 is located on the downstream side of the first metal deck panel. A second metal deck sheet 92, having a longitudinal edge portion 94 located on the upstream side of the second metal deck sheet, is positioned on top of the first metal deck sheet so that the edge portions 90 and 94 of the first and second metal deck sheets 58 and 92, respectively, overlap. Therefore, the first layer of temporary waterproofing sealant 88 will provide for a temporary waterproof seal between the first and second metal deck sheets 58 and 90. This overlapping and sealing procedure is repeated after every new metal deck sheet is fastened down. The ends of adjacent metal deck sheets are also overlapped and applied with a sealant which provides for a temporary seal.

The use of the term "temporary sealant" in this specification refers to any suitable seal which provides for a waterproof seal that is intended to be merely a temporary waterproofing system and not a permanent waterproofing system for the roof structure 40. A temporary waterproofing system is one that would be expected to keep out most of the water from rain, for example, but would not be expected to be a permanent waterproofing system for a long duration of time, such as several months. Such a temporary waterproofing system may not be expected to be waterproof for a heavy rain or snowstorm.

Optionally, a second layer 96 of temporary waterproofing sealant may be applied at the seam 60, which is located at the upstream edge 95 of the second metal deck sheet 92. Preferably, the second layer of temporary waterproofing sealant 96 is applied by spraying an adhesive on top of the seam 60. Of course, either the first layer 88 or second layer 96 of temporary sealant can be applied as the sole temporary sealant for the roof structure 40, or they can be applied in combination.

In situations in which large holes or openings must be made in the roof structure 40 to accommodate, for example pipes or heating, ventilation, and air conditioning systems, the temporary waterproofing system may include sealing the edges of the opening temporarily to protect the flexible insulation material underneath the metal deck. Preferably, an enclosure panel or cover (not shown) is used to temporarily seal the exposed sides of the insulation cavity 72. The enclosure panel can simply be a formed piece of waterproof material which is formed to follow the contour of the exposed roof structure 86. Preferably, the enclosure panel has a sealing strip, such as a bead of asphalt-based sealant or a double sided strip of mastic, applied to the edges of the enclosure which contact the roof. While the enclosure panel does not prevent water from flowing through the large opening into the building structure below, the enclosure panel does prevent or inhibit water from entering the insulation cavity and damaging the flexible insulation material.

Typically a team of roofers will install the rigid insulation board 82 and the waterproof membrane 84. The rigid insulation board 82 can be any suitable rigid insulation board, such as high density glass wool (about 10 lbs/ft$^3$, or about 160 kg/m$^3$), rockwool, or styrene foam, and is typically about 1 to about 2 inches (2.5 to about 10 cm) thick. The rigid insulation board particularly insulates the region of the roof structure above the truss, since there is no flexible insulation material present. The waterproof membrane can be made of any suitable material, for example, built up roof (BUR), ethylene propylene diamine monomer (EPDM), polyvinyl chloride (PVC), and modified bitumen, such as asphalt modified with styrene-butadiene-styrene (SBS) or atactic-polypropylene (APP). The application of waterproof membrane provides for a relatively permanent waterproof roof structure 86.

If the waterproof membrane develops a leak, the rigid insulation board typically will saturate with water, thus decreasing the insulating qualities of the rigid insulation board. However, the water leakage is likely not to transmit through the metal deck sheets having the temporary sealant, and thus is likely not to damage the flexible insulating material 54. Therefore, since most of the insulating properties of the structure of the present invention are accomplished by the flexible insulation material, it is likely that the insulating properties of the roof structure 86 of the present invention will not degrade as much as the prior art roof structure 30 shown in FIG. 2 upon failure of the waterproof membrane.

In addition, it should be noted that the method of the present invention provides a relatively low cost, relatively high insulating value roof structure. In particular, the method of the present invention allows the use of relatively thick layers of insulation to be applied in a relatively low installed cost manner, such as by a carriage, while at the same time making use of relatively low cost metal deck sheets.

It will be evident from the foregoing that various modifications can be made to this invention. Such, however, are considered as being within the scope of the invention.

What is claimed is:

1. A method for providing a roof structure having a plurality of trusses spaced apart from one another in a parallel arrangement, the trusses having top portions, respectively, the method comprising:

a. paying out a support sheet so that the support sheet depends from the top portions of adjacent trusses;

b. applying flexible insulation material above the support sheet so that the flexible insulation material is supported by the support sheet;

c. fastening metal deck sheets to the top portion of the trusses to form a metal deck; and d. applying a temporary waterproofing sealant to the metal deck to protect the flexible insulation material.

2. The method of claim 1 further comprising subsequently applying a waterproof membrane above the metal deck to provide a permanently waterproofed roof structure.

3. The method of claim 1 further comprising applying rigid insulation board on top of the metal deck sheets.

4. The method of claim 1 further comprising subsequently applying rigid insulation board on top of the metal deck sheets and then applying a waterproof membrane above the rigid insulation board to provide a permanently waterproofed roof structure.

5. The method of claim 1, wherein said sealant is an asphalt and said method further comprises the step of oxidizing the asphalt prior to applying it such that it has a melting point between about 165° F. and about 200° F.

6. A method for providing a roof structure having a plurality of trusses spaced apart from one another in a parallel arrangement, the trusses having top portions, respectively, the method comprising:

a. paying out a support sheet so that the support sheet depends from the top portions of adjacent trusses;

b. applying flexible insulation material above the support sheet so that the flexible insulation material is supported by the support sheet;

c. fastening metal deck sheets to the top portion of the trusses to form a metal deck;

d. applying a temporary waterproofing sealant to the metal deck to protect the flexible insulation material; and e. subsequently applying a waterproof membrane above the metal deck to provide a permanently waterproofed roof structure.

7. The method of claim 6 in which the waterproof membrane is a built up roof.

8. The method of claim 6 in which the waterproof membrane is an ethylene propylene diamine monomer.

9. The method of claim 6 comprising applying rigid insulation board to the roof structure, in which the rigid insulation board is positioned between the metal deck and the waterproof membrane.

10. The method of claim 9 in which the rigid insulation board includes styrene foam.

11. The method of claim 9 in which the rigid insulation board includes glass wool.

12. The method of claim 6 in which the support sheet is perforated.

13. The method of claim 6 in which the support sheet is payed out from a roll mounted on a carriage which moves along the length of the trusses.

14. The method of claim 6 in which the metal deck sheets have edge portions which are fastened to the top portion of the trusses in an overlapping manner, thereby creating a seam.

15. The method of claim 14 in which the temporary waterproofing sealant is applied over the seam of the overlapping metal deck sheets.

16. The method of claim 14 in which the temporary waterproofing sealant is applied between the edge portions of adjacent metal deck sheets which overlap.

17. The method of claim 14 in which a first layer of temporary waterproofing sealant is applied between the portions of the adjacent metal deck sheets which overlap, and a second layer of temporary waterproofing sealant is applied on top of the seam of the overlapping metal deck sheets.

18. The method of claim 6 wherein said sealant has a melting point of above about 165° F.

19. A method for providing a roof structure having a plurality of trusses spaced apart from one another in a parallel arrangement, the trusses having top portions, respectively, the method comprising:

a. paying out a support sheet so that the support sheet depends from the top portions of adjacent trusses;

b. applying flexible insulation material above the support sheet so that the flexible insulation material is supported by the support sheet;

c. fastening metal deck sheets to the top portion of the trusses to form a metal deck, in which the metal deck sheets have edge portions which are fastened to the top portion of the trusses in an overlapping manner thereby creating a seam;

d. applying a temporary waterproofing sealant to the metal deck to protect the flexible insulation material;

e. subsequently applying rigid insulation board on top of the metal deck; and f. applying a waterproof membrane on top of the rigid insulation board to provide a permanently waterproofed roof structure.

20. The method of claim 19 in which the temporary waterproofing sealant is applied on top of the seam.

21. The method of claim 19 in which temporary waterproofing sealant is applied between the edge portions of adjacent metal deck sheets.

22. The method of claim 19 in which a first layer of temporary waterproofing sealant is applied between the edge portions of metal deck sheets, and a second layer of temporary waterproofing sealant is applied on top of the seam.

23. The method of claim 19, wherein said sealant is an asphalt, said method further comprising oxidizing the asphalt prior to applying it so that it has a melting point between about 165° F. and about 200° F.

* * * * *